US008434953B2

(12) United States Patent
Sawai

(10) Patent No.: US 8,434,953 B2
(45) Date of Patent: May 7, 2013

(54) THERMAL PRINT HEAD MOUNTING APPARATUS

(75) Inventor: Kunio Sawai, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 1204 days.

(21) Appl. No.: 11/785,240

(22) Filed: Apr. 16, 2007

(65) Prior Publication Data

US 2007/0248395 A1 Oct. 25, 2007

(30) Foreign Application Priority Data

Apr. 17, 2006 (JP) ..... 2006-112857

(51) Int. Cl.
*B41J 25/43* (2006.01)

(52) U.S. Cl.
USPC ..... 400/120.16; 400/120.17

(58) Field of Classification Search ..... 400/120.16, 400/120.17; 347/197, 198, 222; 16/268, 16/262, 266; *B41J 25/34, 25/43; E05D 7/19, E05D 7/12, 11/00, 11/06*
See application file for complete search history.

(56) References Cited

U.S. PATENT DOCUMENTS

| | | | | | |
|---|---|---|---|---|---|
| 4,515,424 | A | * | 5/1985 | Sakurai | 439/325 |
| 5,026,036 | A | * | 6/1991 | Takahashi | 271/3.03 |
| 5,071,266 | A | * | 12/1991 | Harada et al. | 400/120.17 |
| 5,096,314 | A | * | 3/1992 | Komori et al. | 400/175 |
| 5,272,488 | A | * | 12/1993 | Kim | 347/220 |
| 5,657,066 | A | * | 8/1997 | Adams et al. | 347/198 |
| 5,746,520 | A | * | 5/1998 | Kohira | 400/120.01 |
| 5,835,232 | A | * | 11/1998 | Kameyama | 358/296 |
| 5,959,653 | A | | 9/1999 | Sekiya | |
| 6,017,159 | A | * | 1/2000 | Tse | 400/208 |
| 6,354,478 | B1 | * | 3/2002 | Bruckel | 226/88 |
| 7,014,376 | B2 | | 3/2006 | Maruyama et al. | |
| 2005/0063752 | A1 | * | 3/2005 | Sawai | 400/120.16 |

FOREIGN PATENT DOCUMENTS

| | | | | |
|---|---|---|---|---|
| JP | 9-216394 | A | | 8/1997 |
| JP | 10-119326 | A | | 5/1998 |
| JP | 3001804 | B2 | | 11/1999 |
| JP | 2004-223731 | A | | 8/2004 |
| JP | 2005-349725 | A | | 12/2005 |
| JP | 2005349725 | A | * | 12/2005 |

* cited by examiner

*Primary Examiner* — Judy Nguyen
*Assistant Examiner* — Jennifer Simmons
(74) *Attorney, Agent, or Firm* — Crowell & Moring LLP

(57) ABSTRACT

This image generating apparatus comprises a chassis including a first mounting portion and a second mounting portion and a print head including a first arm and a second arm rotatably mounted on the first mounting portion and said second mounting portion respectively. The first arm and the second arm of the print head are provided with a first stop portion and a second stop portion regulating movement of the print head in the direction of a rotation axis respectively, while a first angular range in which the first arm is mountable on/dismountable from the first mounting portion is different from a second angular range in which the second arm is mountable on/dismountable from the second mounting portion.

13 Claims, 8 Drawing Sheets

THERMAL PRINT HEAD MOUNTING APPARATUS

BACKGROUND OF THE INVENTION

1. Field of the Invention

The present invention relates to an image generating apparatus, and more particularly, it relates to an image generating apparatus comprising a print head.

2. Description of the Background Art

Image generating apparatuses comprising print heads are known in general, as disclosed in Japanese Patent Laying-Open Nos. 2005-349725, 9-226204 (1997), 10-119326 (1998), 2004-223731 and 9-216394 (1997), for example.

The image generating apparatus described in the aforementioned Japanese Patent Laying-Open No. 2005-349725 comprises a print head having a pair of arms and a chassis having a pair of mounting portions on which the pair of arms of the print head are rotatably mounted. One of the pair of arms is provided with a stopper (stop portion). According to Japanese Patent Laying-Open No. 2005-349725, the stopper inhibits the print head from dropping.

The image generating apparatus described in the aforementioned Japanese Patent Laying-Open No. 9-226204 comprises a frame (chassis), a shaft (rotation axis) mounted on the frame and a head plate (print head) rotatably mounted on the shaft. According to Japanese Patent Laying-Open No. 9-226204, a stop ring is mounted on the shaft, thereby inhibiting the head plate (print head) from deviating in the direction of the rotation axis with respect to the shaft (rotation axis).

The image generating apparatus described in the aforementioned Japanese Patent Laying-Open No. 10-119326 comprises a print head having a rotation axis and a frame (chassis) integrally having an upwardly opening bearing supporting the rotation axis of the print head. According to Japanese Patent Laying-Open No. 10-119326, the print head is moved downward from above, so that the rotation axis thereof is mounted on the bearing of the frame.

The image generating apparatus described in the aforementioned Japanese Patent Laying-Open No. 2004-223731 comprises a body case (chassis) and a print head rotatably mounted on a support shaft (rotation axis) provided on the body case. The print head has a receiving hole. According to Japanese Patent Laying-Open No. 2004-223731, the support shaft (rotation axis) is inserted into the receiving hole of the print head, so that the print head is rotatably mounted on the support shaft (rotation axis).

The image generating apparatus described in the aforementioned Japanese Patent Laying-Open No. 9-216394 comprises a housing having a guide groove and a print head having a rotation axis. According to Japanese Patent Laying-Open No. 9-216394, the rotation axis of the print head is guided through the guide groove of the housing, so that the print head is mounted on the housing.

In the image generating apparatus described in the aforementioned Japanese Patent Laying-Open No. 2005-349725, however, the stopper (stop portion) is provided on only one of the pair of arms. If an impact is applied to the image generating apparatus, therefore, the other arm may disadvantageously drop from the image generating apparatus.

In the image generating apparatus described in the aforementioned Japanese Patent Laying-Open No. 9-226204, the stop ring is separately provided for inhibiting the head plate from deviating in the direction of the rotation axis with respect to the shaft, whereby the number of components is disadvantageously increased.

Each of the image generating apparatuses described in the aforementioned Japanese Patent Laying-Open Nos. 10-119326, 2004-223731 and 9-216394 is conceivably provided with no structure regulating the position of the print head in the direction of the rotation axis, although this is not clearly described. Therefore, it may conceivably be difficult to inhibit the print head from deviating in the direction of the rotation axis.

SUMMARY OF THE INVENTION

The present invention has been proposed in order to solve the aforementioned problems, and an object of the present invention is to provide an image generating apparatus capable of inhibiting a print head from deviating in the direction of a rotation axis while suppressing increase of the number of components and also capable of inhibiting the print head from dropping.

An image generating apparatus according to a first aspect of the present invention comprises a chassis including a first mounting portion and a second mounting portion and a print head including a first arm and a second arm rotatably mounted on the first mounting portion and the second mounting portion of the chassis respectively, the first arm and the second arm of the print head are integrally provided with a first stop portion and a second stop portion regulating movement of the print head in the direction of a rotation axis respectively, a first angular range in which the first arm of the print head is mountable on/dismountable from the first mounting portion of the chassis is different from a second angular range in which the second arm of the print head is mountable on/dismountable from the second mounting portion of the chassis, and the first arm and the second arm of the print head are mounted on the first mounting portion and the second mounting portion of the chassis in the first angular range and the second angular range respectively and the print head is thereafter so rotated that the print head is stopped by the first stop portion and the second stop portion in the direction of the rotation axis.

In the image generating apparatus according to the first aspect, as hereinabove described, the first and second stop portions are provided on the first and second arms of the print head mounted on the chassis respectively for regulating movement of the print head in the direction of the rotation axis, whereby the print head can be inhibited from deviating in the direction of the rotation axis. Thus, the first and second arms of the print head can be inhibited from slipping off the first and second mounting portions of the chassis respectively, thereby inhibiting the print head from dropping. Further, the first and second stop portions are integrally provided on the first and second arms respectively, whereby the print head can be inhibited from deviating in the direction of the rotation axis while suppressing increase of the number of components. In addition, the first angular range in which the first arm of the print head is mountable on/dismountable from the first mounting portion of the chassis is rendered different from the second angular range in which the second arm of the print head is mountable on/dismountable from the second mounting portion of the chassis while the first and second arms of the print head are mounted on the first and second mounting portions of the chassis in the first and second angular ranges respectively and the print head is thereafter so rotated that the first and second stop portions stop the print head in the direction of the rotation axis, whereby the first and second arms can be easily and reliably mounted on the first and second mounting portions respectively independently of each other when it is difficult to simultaneously mount the first and second arms on the first and second mounting portions respectively.

The aforementioned image generating apparatus according to the first aspect is preferably so formed that the first arm is mounted on the first mounting portion in the first angular range and the print head is thereafter rotated in a prescribed angular range to reach the second angular range for bringing the first arm into a first state stopped from slipping off the first mounting portion by the first stop portion and mounting the second arm on the second mounting portion in the first state. According to this structure, the first arm can be inhibited from slipping off the first mounting portion when the second arm is mounted on the second mounting portion, whereby workability in mounting can be improved.

In the aforementioned image generating apparatus according to the first aspect, the distance between a side surface of the first mounting portion of the chassis mounted with the first arm and a side surface of the second mounting portion of the chassis mounted with the second arm is preferably substantially equal to the distance between a side surface of the first arm mounted on the first mounting portion and a side surface of the second arm mounted on the second mounting portion. According to this structure, the first and second arms mounted on the first and second mounting portions respectively can be inhibited from deflecting and pressing the side surfaces of the first and second mounting portions mounted with the first and second arms respectively. Thus, pressing force can be inhibited from acting between the first and second mounting portions of the chassis and the first and second arms in rotation of the print head, whereby the print head can be smoothly rotated.

In the aforementioned image generating apparatus according to the first aspect, the first mounting portion and the second mounting portion of the chassis are preferably provided with a first notch and a second notch respectively, the first notch and the second notch preferably have shapes different from each other, the first notch is preferably so formed as to relieve the first stop portion when the first arm of the print head is mounted on the first mounting portion in the first angular range, and the second notch is preferably so formed as to relieve the second stop portion when the second arm of the print head is mounted on the second mounting portion in the second angular range. According to this structure, the first angular range in which the first arm of the print head is mountable on/dismountable from the first mounting portion of the chassis can be easily rendered different from the second angular range in which the second arm of the print head is mountable on/dismountable from the second mounting portion of the chassis due to the different shapes of the first and second notches.

In this case, the first notch of the first mounting portion of the chassis and the second notch of the second mounting portion of the chassis are preferably so formed as to have different notch angles. According to this structure, the first angular range in which the first arm of the print head is mountable on/dismountable from the first mounting portion of the chassis can be easily rendered different from the second angular range in which the second arm of the print head is mountable on/dismountable from the second mounting portion of the chassis through the first and second notches.

In the aforementioned image generating apparatus according to the first aspect, the first mounting portion and the second mounting portion are preferably integrally formed on the chassis by partially uprighting the bottom surface of the chassis. According to this structure, the number of components can be inhibited from increase despite provision of the first and second mounting portions.

In the aforementioned image generating apparatus according to the first aspect, the first arm and the second arm preferably include a first protrusion and a second protrusion each serving as the rotation axis respectively, and the first mounting portion and the second mounting portion preferably include a first receiving hole and a second receiving hole receiving the first protrusion and the second protrusion respectively. According to this structure, the first and second arms can be easily rotated about the first and second protrusions serving as rotation centers respectively.

In this case, the projection lengths of the first protrusion and the second protrusion are preferably not more than the thicknesses of the first mounting portion and the second mounting portion respectively. According to this structure, the first and second protrusions can be easily inserted into the first and second receiving holes of the first and second mounting portions respectively, whereby the image generating apparatus can be easily assembled.

In the aforementioned image generating apparatus according to the first aspect, the first stop portion and the second stop portion may include a first L-shaped stop section and a second L-shaped stop section protruding from the first arm and the second arm respectively.

In this case, the lengths of portions of the first stop section and the second stop section holding the first mounting portion and the second mounting portion are preferably substantially equal to the thicknesses of the first mounting portion and the second mounting portion respectively. According to this structure, the first and second arms provided with the first and second stop sections can be inhibited from jolting with respect to the first and second mounting portions respectively.

An image generating apparatus according to a second aspect of the present invention comprises a chassis and a print head, the chassis includes a first mounting portion and a second mounting portion, the print head includes a first arm and a second arm rotatably mounted on the first mounting portion and the second mounting portion of the chassis respectively, the first arm and the second arm of the print head are integrally provided with a first stop portion and a second stop portion regulating movement of the print head in the direction of a rotation axis respectively, a first angular range in which the first arm of the print head is mountable on/dismountable from the first mounting portion of the chassis is different from a second angular range in which the second arm of the print head is mountable on/dismountable from the second mounting portion of the chassis, the first arm and the second arm of the print head are mounted on the first mounting portion and the second mounting portion of the chassis in the first angular range and the second angular range respectively and the print head is thereafter so rotated that the print head is stopped by the first stop portion and the second stop portion in the direction of the rotation axis, the first arm is mounted on the first mounting portion in the first angular range and the print head is thereafter rotated in a prescribed angular range to reach the second angular range for bringing the first arm into a first state stopped from slipping off the first mounting portion by the first stop portion and mounting the second arm on the second mounting portion in the first state, the distance between a side surface of the first mounting portion of the chassis mounted with the first arm and a side surface of the second mounting portion of the chassis mounted with the second arm is substantially equal to the distance between a side surface of the first arm mounted on the first mounting portion and a side surface of the second arm mounted on the second mounting portion, the first mounting portion and the second mounting portion of the chassis are provided with a first notch and a second notch respectively, the first notch and the second notch have shapes different from each other, the first notch is so formed as to relieve the first stop portion when the first arm of the print head is mounted on the first mounting portion in the first angular range, the second notch is so formed as to relieve the second stop portion when the second arm of the print head is mounted on the second mounting portion in the second angular range, and the first notch of the first mounting portion and the second notch of the second mounting portion are so formed as to have different notch angles.

In the image generating apparatus according to the second aspect, as hereinabove described, the first and second stop portions are provided on the first and second arms of the print head mounted on the chassis respectively for regulating movement of the print head in the direction of the rotation axis, whereby the print head can be inhibited from deviating in the direction of the rotation axis. Thus, the first and second arms of the print head can be inhibited from slipping off the first and second mounting portions of the chassis respectively, thereby inhibiting the print head from dropping. Further, the first and second stop portions are integrally provided on the first and second arms respectively, whereby the print head can be inhibited from deviating in the direction of the rotation axis while suppressing increase of the number of components. In addition, the first angular range in which the first arm of the print head is mountable on/dismountable from the first mounting portion of the chassis is rendered different from the second angular range in which the second arm of the print head is mountable on/dismountable from the second mounting portion of the chassis while the first and second arms of the print head are mounted on the first and second mounting portions of the chassis in the first and second angular ranges respectively and the print head is thereafter so rotated that the first and second stop portions stop the print head in the direction of the rotation axis, whereby the first and second arms can be easily and reliably mounted on the first and second mounting portions respectively independently of each other when it is difficult to simultaneously mount the first and second arms on the first and second mounting portions respectively. Further, the first arm is mounted on the first mounting portion in the first angular range and the print head is thereafter rotated in the prescribed angular range to reach the second angular range for bringing the first arm into the first state stopped from slipping off the first mounting portion by the first stop portion and mounting the second arm on the second mounting portion in the first state so that the first arm can be inhibited from slipping off the first mounting portion when the second arm is mounted on the second mounting portion, whereby workability in mounting can be improved.

In the image generating apparatus according to the second aspect, as hereinabove described, the distance between the side surface of the first mounting portion mounted with the first arm and the side surface of the second mounting portion mounted with the second arm is substantially equal to the distance between the side surface of the first arm mounted on the first mounting portion and the side surface of the second arm mounted on the second mounting portion, whereby the first and second arms mounted on the first and second mounting portions respectively can be inhibited from deflecting and pressing the side surfaces of the first and second mounting portions mounted with the first and second arms respectively. Thus, pressing force can be inhibited from acting between the first and second mounting portions of the chassis and the first and second arms in rotation of the print head, whereby the print head can be smoothly rotated. Further, the first and second mounting portions of the chassis are provided with the first and second notches having different shapes respectively for relieving the first stop portion through the first notch when the first arm of the print head is mounted on the first mounting portion in the first angular range and relieving the second stop portion through the second notch when the second arm of the print head is mounted on the second mounting portion in the second angular range, whereby the first angular range in which the first arm of the print head is mountable on/dismountable from the first mounting portion of the chassis can be easily rendered different from the second angular range in which the second arm of the print head is mountable on/dismountable from the second mounting portion of the chassis. In addition, the first and second notches of the first and second mounting portions are so formed as to have different notch angles, whereby the first angular range in which the first arm of the print head is mountable on/dismountable from the first mounting portion of the chassis can be easily rendered different from the second angular range in which the second arm of the print head is mountable on/dismountable from the second mounting portion of the chassis through the first and second notches.

In the aforementioned image generating apparatus according to the second aspect, the first mounting portion and the second mounting portion are preferably integrally formed on the chassis by partially uprighting the bottom surface of the chassis. According to this structure, the bottom surface of the chassis. According to this structure, the number of components can be inhibited from increase despite provision of the first and second mounting portions.

In the aforementioned image generating apparatus according to the second aspect, the first arm and the second arm preferably include a first protrusion and a second protrusion each serving as the rotation axis respectively, and the first mounting portion and the second mounting portion preferably include a first receiving hole and a second receiving hole receiving the first protrusion and the second protrusion respectively. According to this structure, the first and second arms can be easily rotated about the first and second protrusions serving as rotation centers respectively.

In this case, the projection lengths of the first protrusion and the second protrusion are preferably not more than the thicknesses of the first mounting portion and the second mounting portion respectively. According to this structure, the first and second protrusions can be easily inserted into the first and second receiving holes of the first and second mounting portions respectively, whereby the image generating apparatus can be easily assembled.

In the aforementioned image generating apparatus according to the second aspect, the first stop portion and the second stop portion may include a first L-shaped stop section and a second L-shaped stop section protruding from the first arm and the second arm respectively.

In this case, the lengths of portions of the first stop section and the second stop section holding the first mounting portion and the second mounting portion are preferably substantially equal to the thicknesses of the first mounting portion and the second mounting portion respectively. According to this structure, the first and second arms provided with the first and second stop sections can be inhibited from jolting with respect to the first and second mounting portions respectively.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of a thermal transfer printer according to this embodiment is described with reference to FIGS. 1 to 9. This embodiment of the present invention is applied to the thermal transfer printer employed as an exemplary image generating apparatus.

Figure 1:
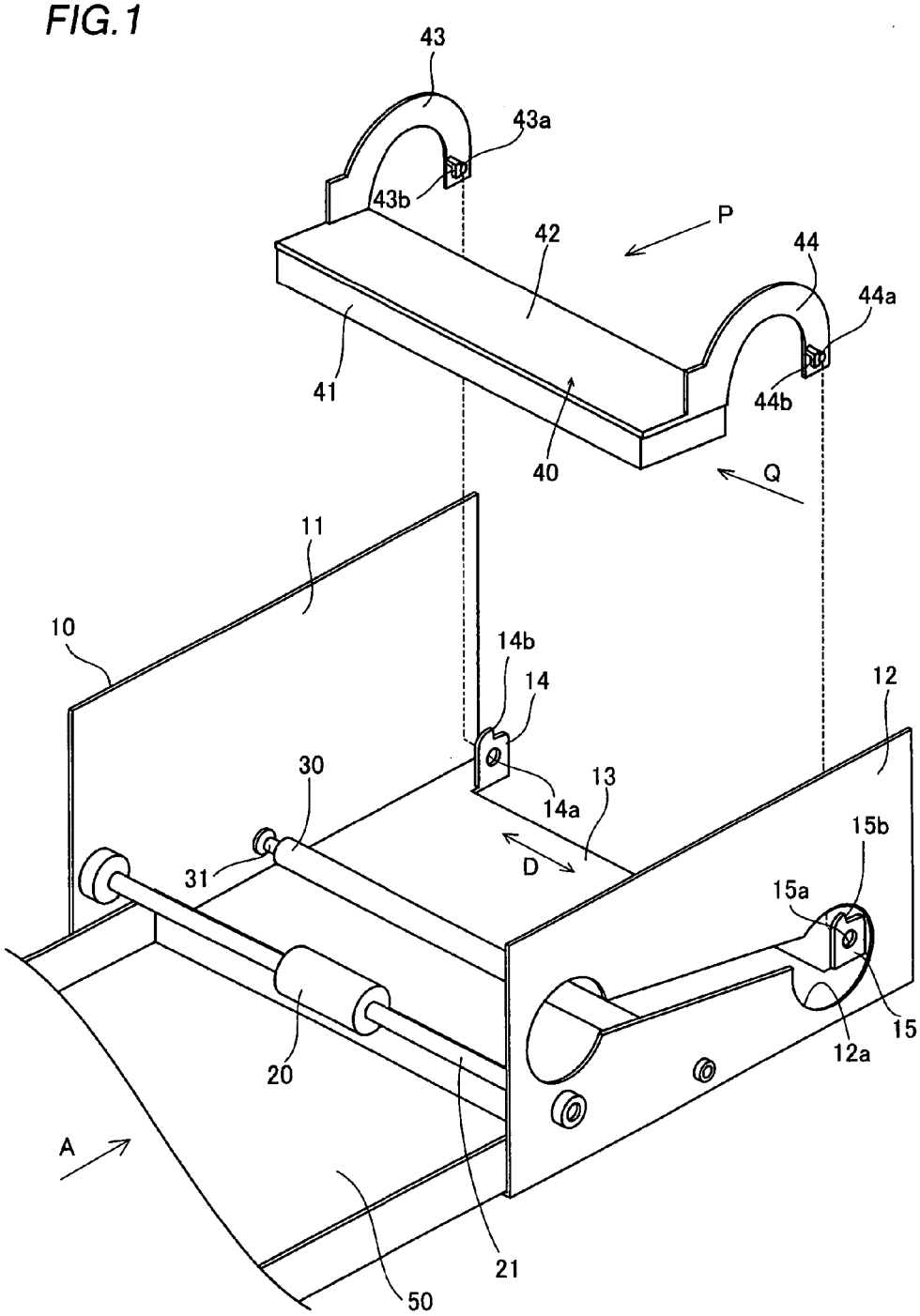
FIG. 1 is an exploded perspective view showing the overall structure of a thermal transfer printer according to an embodiment of the present invention.
Figure 2:
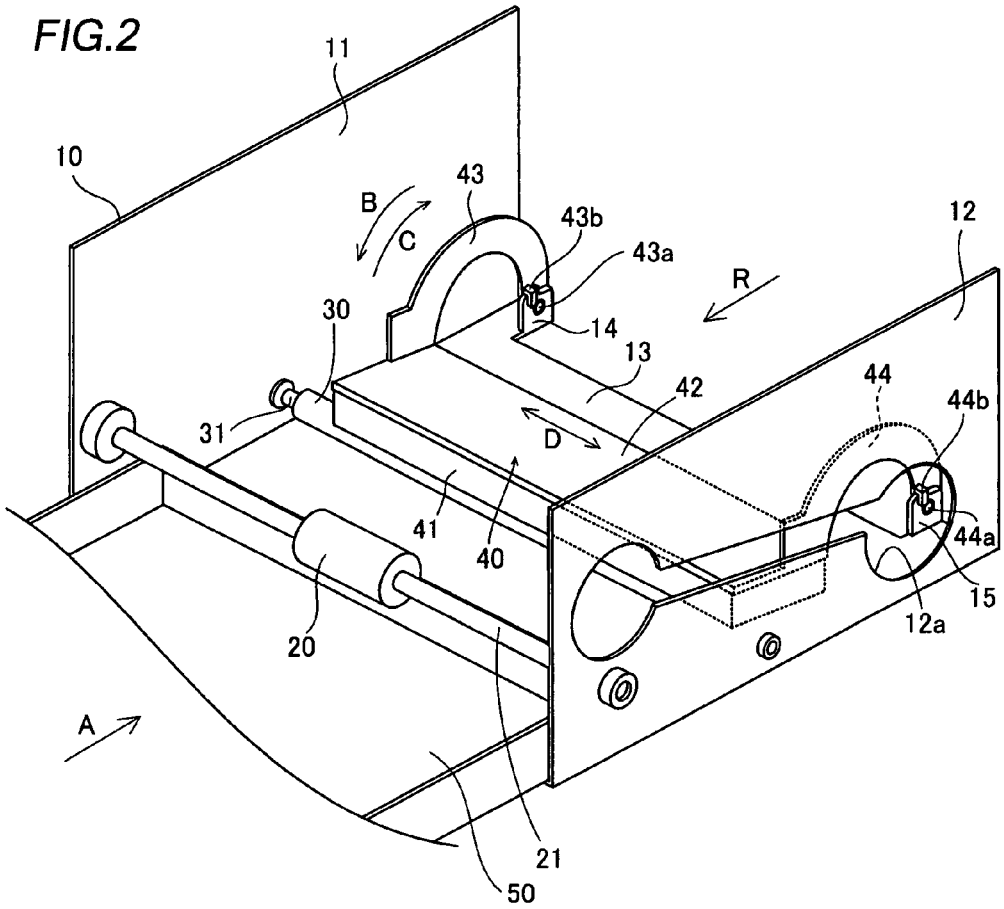
FIG. 2 is a perspective view showing a print head of the thermal transfer printer according to the embodiment of the present invention in a state mounted on a chassis.
Figure 4:
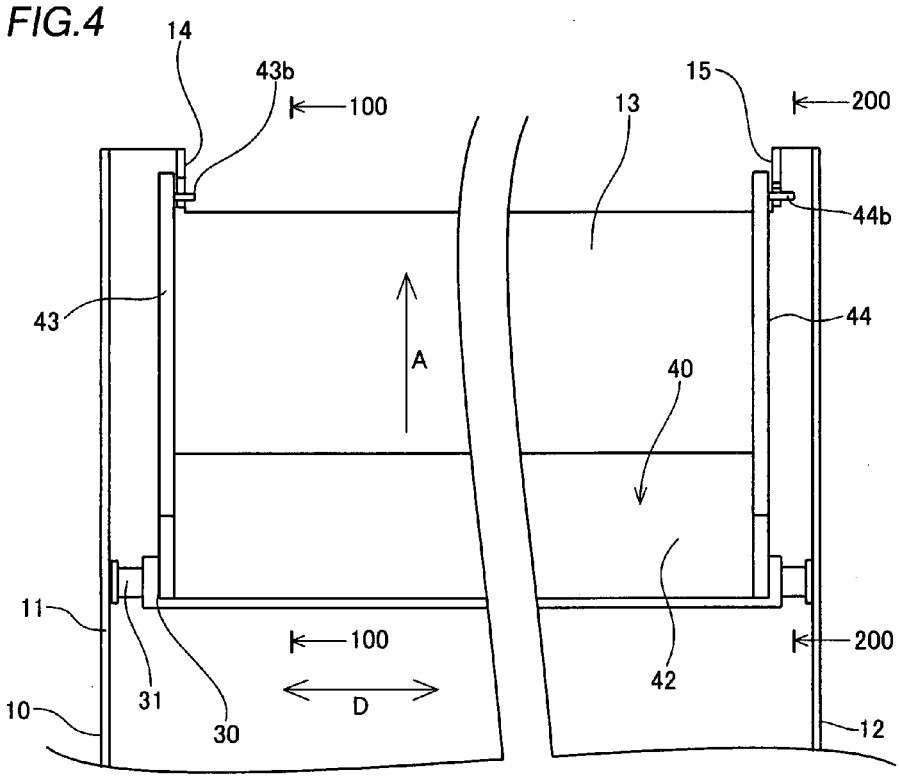
FIG. 4 is a plan view showing the print head of the thermal transfer printer according to the embodiment of the present invention in the state mounted on the chassis.

The thermal transfer printer according to this embodiment comprises a chassis 10 of metal, a paper feed roller 20 (see FIGS. 1 and 2) of rubber, a platen roller 30 of rubber and a print head 40, as shown in FIGS. 1, 2 and 4. A paper feed cassette 50 (see FIGS. 1 and 2) storing papers (not shown) is detachably mounted on the thermal transfer printer.

The chassis 10 includes a first side surface 11, a second side surface 12 and a bottom surface 13 coupling the first and second side surfaces 11 and 12 with each other, as shown in FIGS. 1 and 2. The second side surface 12 is provided with a receiving hole 12*a* for receiving an ink sheet cartridge (not shown) storing an ink sheet (not shown).

The paper feed roller 20 of rubber has a function of carrying each paper (not shown) stored in the paper feed cassette 50 in a paper feed direction (along arrow A) in the thermal transfer printer. This paper feed roller 20 is mounted in the vicinity of the center of a paper feed roller shaft 21 of metal. The paper feed roller shaft 21 is rotatably mounted on the first and second side surfaces 11 and 12 of the chassis 10.

The platen roller 30 of rubber is mounted on a platen roller shaft 31 of metal rotatably mounted on the first and second side surfaces 11 and 12 of the chassis 10.

Figure 6:
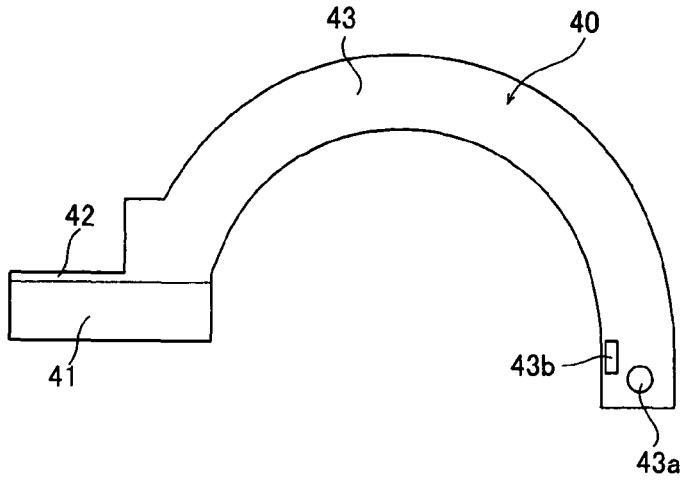
FIG. 6 is a front elevational view showing the print head of the thermal transfer printer according to the embodiment of the present invention as viewed from a direction Q in FIG. 1.

The print head 40 is rotatably mounted on the bottom surface 13 of the chassis 10. This print head 40 is so formed as to generate heat in a state holding each paper (not shown) and the ink sheet (not shown) between the same and the platen roller 30. In the thermal transfer printer according to this embodiment, the print head 40 so generates heat as to sublimate ink of the ink sheet (not shown) and transfer the ink to the paper (not shown) thereby performing printing. The print head 40 includes a heat-generating portion 41 having a heat-generating function, a support portion 42 of aluminum, supporting the upper surface of the heat-generating portion 41, having a heat-radiating function and first and second arms 43 and 44 of aluminum integrally provided on both ends of the support portion 42 and rotatably mounted on the bottom surface 13 of the chassis 10. As shown in FIGS. 1 and 6, the first and second arms 43 and 44 are integrally provided on ends of the support portion 42 closer to the first and second side surfaces 11 and 12 of the chassis 10 respectively. These first and second arms 43 and 44 are U-shaped, for relieving the ink sheet cartridge (not shown) inserted therebetween. The first and second arms 43 and 44 are examples of the "first arm" and the "second arm" in the present invention respectively.

Figure 5:
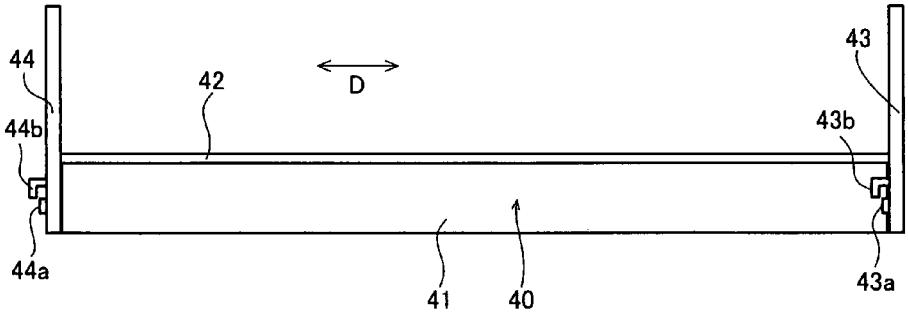
FIG. 5 is a front elevational view showing the print head of the thermal transfer printer according to the embodiment of the present invention as viewed from a direction P in FIG. 1.

As shown in FIG. 5, ends of the first and second arms 43 and 44 include first and second rotation axes 43*a* and 44*a* so integrally provided as to protrude toward the second side surface 12 of the chassis 10 respectively. The first and second rotation axes 43*a* and 44*a* serve as rotation centers for the print head 40. The first and second arms 43 and 44 supporting the heat-generating portion 41 rotate about the first and second rotation axes 43*a* and 44*a* respectively, thereby rotating the heat-generating portion 41 in a direction (along arrow B) for pressing the platen roller 30 and another direction (along arrow C) for separating from the platen roller 30, as shown in FIG. 2. The first and second rotation axes 43*a* and 44*a* are examples of the "first protrusion" and the "second protrusion" in the present invention respectively.

Figure 3:
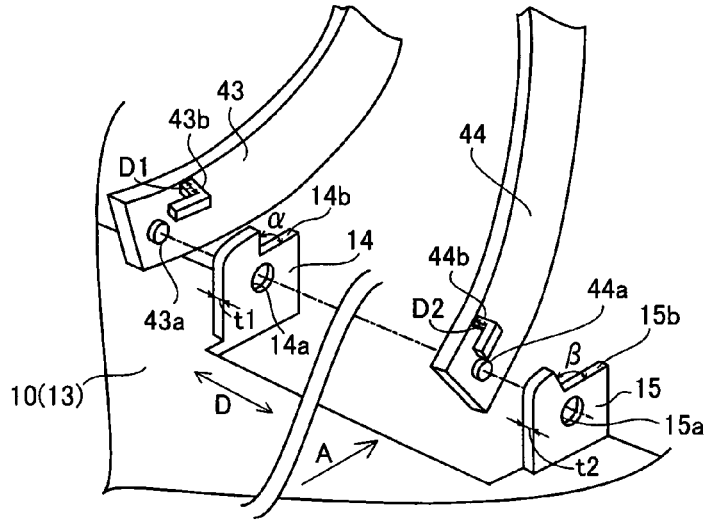
FIG. 3 is a perspective view showing first and second arms and first and second arm mounting portions of the thermal transfer printer according to the embodiment of the present invention.

According to this embodiment, the ends of the first and second arms 43 and 44 further include first and second L-shaped stop portions 43*b* and 44*b* respectively, as shown in FIGS. 1, 3 and 5. The first and second stop portions 43*b* and 44*b* engage with first and second arm mounting portions 14 and 15 described later in the directions (along arrow D) of the first and second rotation axes 43*a* and 44*a* respectively. The first and second stop portions 43*b* and 44*b* are examples of the "first, stop portion" or the "first stop section" and the "second stop portion" or the "second stop section" in the present invention respectively.

Figure 9:
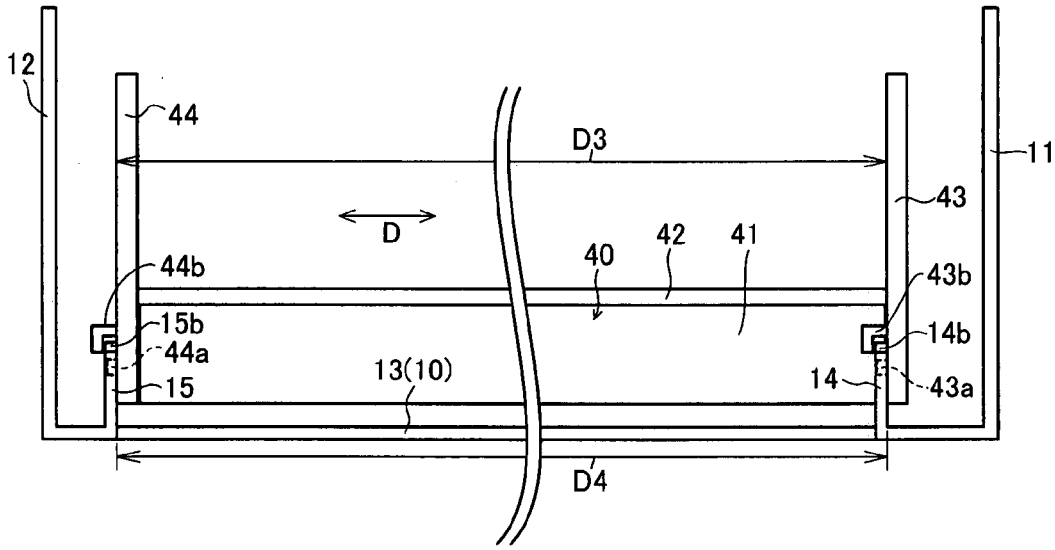
FIG. 9 is a front elevational view showing the print head of the thermal transfer printer according to the embodiment of the present invention as viewed from a direction R in FIG. 2.

According to this embodiment, the first and second arm mounting portions 14 and 15 mounted with the first and second arms 43 and 44 of the print head 40 respectively are provided on the bottom surface 13 of the chassis 10 integrally with the chassis 10, as shown in FIGS. 1 and 3. The first and second arm mounting portions 14 and 15, provided on the rear end of the bottom surface 13 of the chassis 10, are formed by partially uprighting the bottom surface 13. The distance D1 (length of the part of the first stop portion 43*b* holding the first arm mounting portion 14) (see FIG. 3) between the first arm 43 and the first stop portion 43*b* is substantially equal to the thickness t1 (see FIG. 3) of the first arm mounting portion 14, while the distance D2 (length of the part of the second stop portion 44*b* holding the second arm mounting portion 15) (see FIG. 3) between the second arm 44 and the second stop portion 44*b* is substantially equal to the thickness t2 (see FIG. 3) of the second arm mounting portion 15. Further, the projection lengths of the first and second rotation axes 43*a* and 44*a* are not more than the thicknesses t1 and t2 (see FIG. 3) of the first and second arm mounting portions 14 and 15 respectively. As shown in FIG. 9, the distance D3 between side surfaces of the first and second arm mounting portions 14 and 15 mounted with the first and second arms 43 and 44 respectively is substantially equal to the distance D4 between side surfaces of the first and second arms 43 and 44 mounted on the first and second arm mounting portions 14 and 15 respectively. The first and second arm mounting portions 14 and 15 are examples of the "first mounting portion" and the "second mounting portion" in the present invention respectively.

Figure 7:
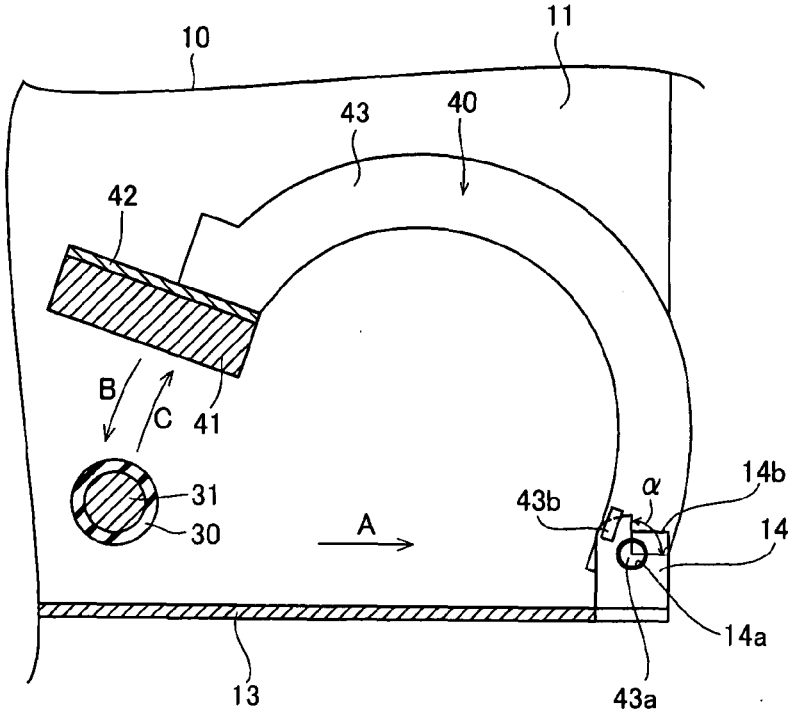
FIG. 7 is a sectional view taken along the line 100-100 in FIG. 4.
Figure 8:
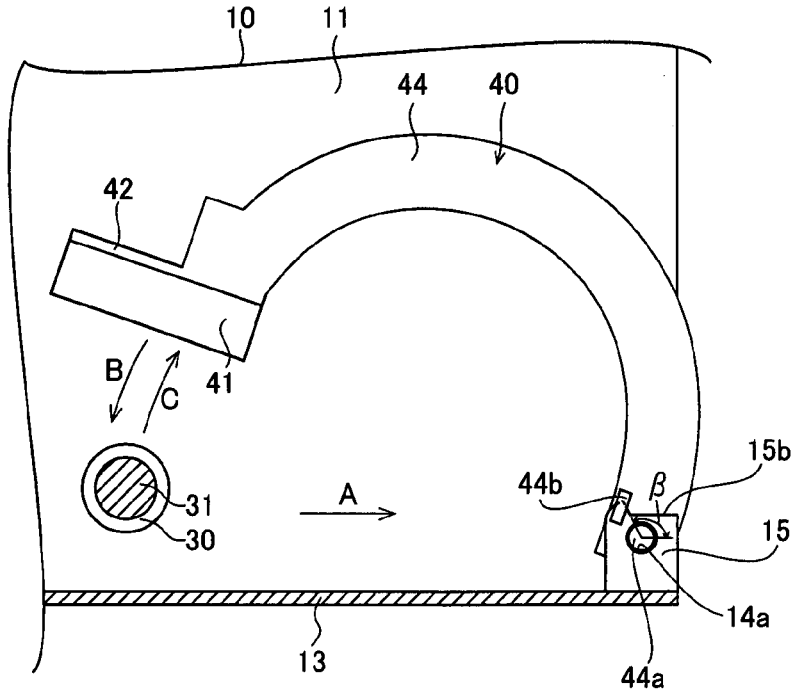
FIG. 8 is a sectional view taken along the line 200-200 in FIG. 4.

As shown in FIGS. 7 and 8, the first and second arm mounting portions 14 and 15 include first and second holes 14*a* and 15*a* rotatably receiving the first and second rotation axes 43*a* and 44*a* respectively and first and second notches 14*b* and 15*b*. The first and second notches 14*b* and 15*b* are provided for relieving the first and second stop portions 43*b* and 44*b* when the first and second rotary axes 43*a* and 44*a* are inserted into the first and second holes 14*a* and 15*a* respectively. The first and second holes 14*a* and 15*a* are examples of the "first receiving hole" and the "second receiving hole" in the present invention respectively.

According to this embodiment, the notch angle (angle α) (see FIGS. 3 and 7) of the first notch 14*b* is rendered smaller than the notch angle (angle β) (see FIGS. 3 and 8) of the second notch 15*b* by at least 30°. Thus, the angular ranges of rotation of the print head 40 for relieving the first and second stop portions 43*b* and 44*b* through the first and second notches 14*b* and 15*b* respectively are rendered different from each other. In other words, the thermal transfer printer according to this embodiment is so formed that the angular ranges in which the first and second arms 43 and 44 are mountable on/dismountable from the first and second arm mounting portions 14 and 15 respectively are different from each other.

A method of mounting the print head 40 on the chassis 10 in the thermal transfer printer according to this embodiment is now described with reference to FIGS. 2, 3, 7, 8 and 10 to 15.

Figure 10:
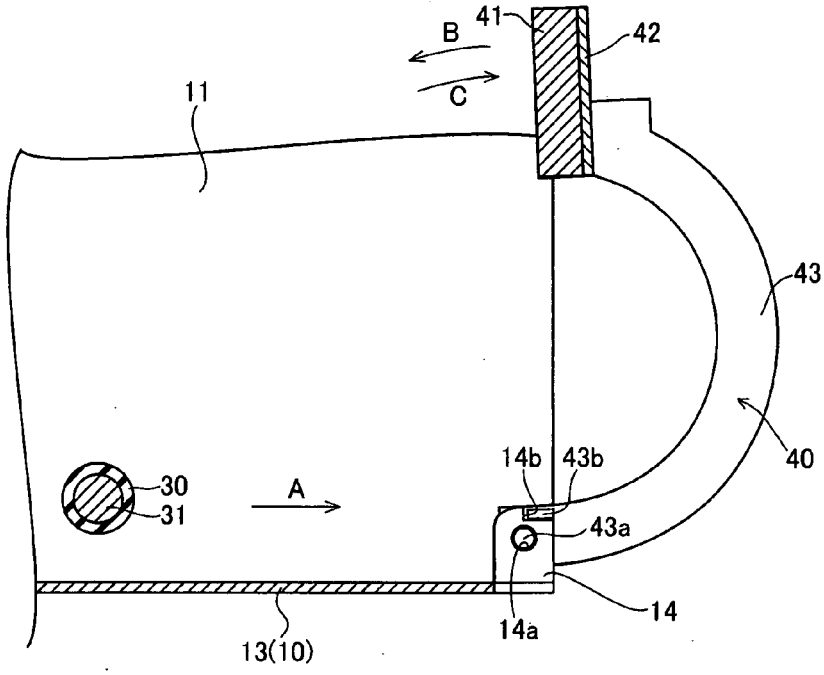
FIGS. 10 and 11 are sectional views taken along the line 100-100 in FIG. 4 for illustrating a method of mounting the print head on the chassis in the thermal transfer printer according to the embodiment of the present invention.
Figure 11:
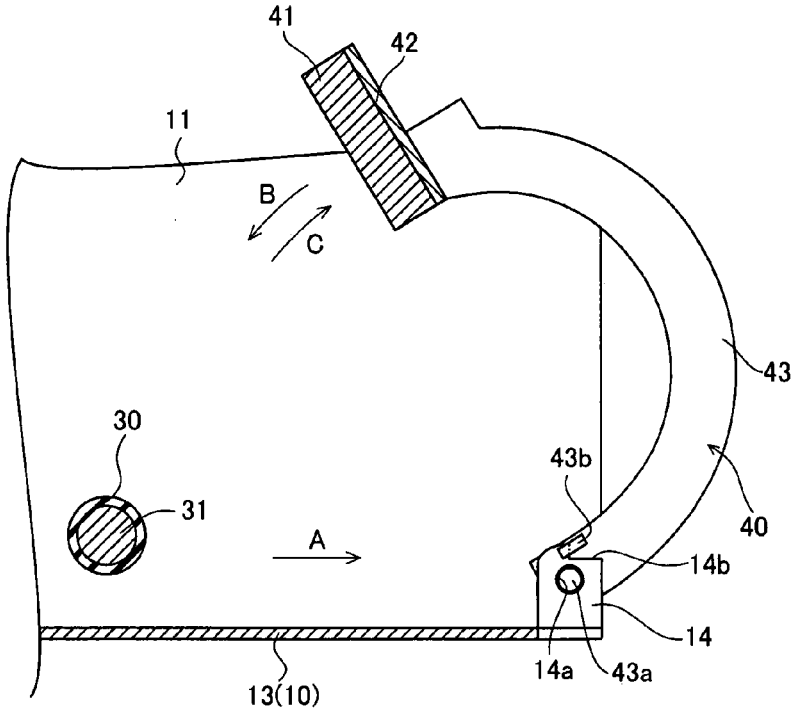

As shown in FIG. 10, the print head 40 is uprightly set for inserting the first rotation axis 43*a* of the first arm 43 into the first hole 14*a* of the first arm mounting portion 14. At this time, the first stop portion 34*b* is relieved through the first notch 14*b* provided on the first arm mounting portion 14. Thus, the first rotation axis 43*a* of the first arm 43 is easily inserted into the first hole 14*a* of the first arm mounting portion 14. Then, the print head 40 is rotated along arrow B in FIG. 10 in a prescribed angular range. Thus, the first stop portion 43*b* of the first arm 43 is engaged with the first arm mounting portion 14 in the direction (along arrow D in FIG. 3) of the rotation axis 43*a*, as shown in FIG. 11.

Figure 12:
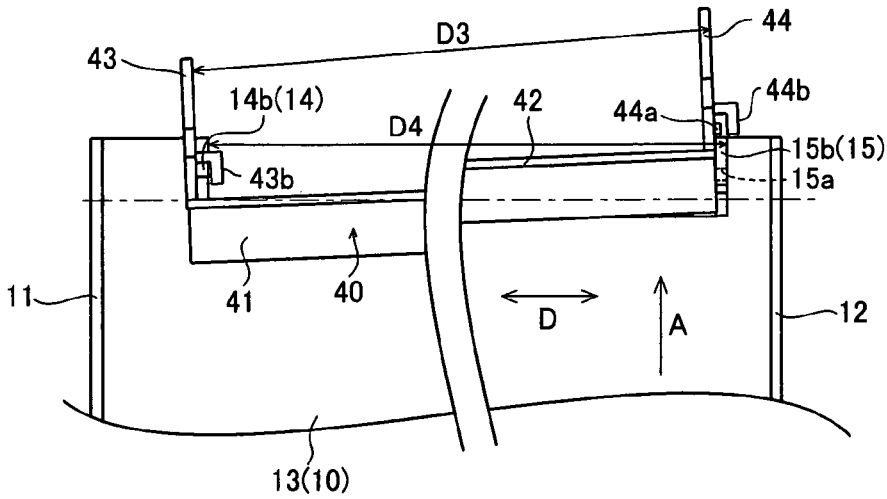
FIG. 12 is a plan view for illustrating the method of mounting the print head on the chassis in the thermal transfer printer according to the embodiment of the present invention.

Upon this engagement of the first stop portion 43*b* and the first arm mounting portion 14, the second rotation axis 44*a* of the second arm 44 is arranged in the vicinity of the second hole 15*a* of the second arm mounting portion 15, to be inserted into the second hole 15*a*. The distance D3 between the side surfaces of the first and second arm mounting portions 14 and 15 mounted with the first and second arms 43 and 44 respectively is substantially equal to the distance D4 between the side surfaces of the first and second arms 43 and 44 mounted on the first and second arm mounting portions 14 and 15 respectively, whereby the protruding second rotation axis 44*a* of the second arm 44 interferes with the second arm mounting portion 15, as shown in FIG. 12. Therefore, a part of the second arm 44 around the second rotation axis 44*a* is deflected along arrow E and the first arm 43 is moved downward in this state so that the second rotation axis 44*a* is arranged in the vicinity of the second hole 15*a*, as shown in FIG. 13.

Figure 13:
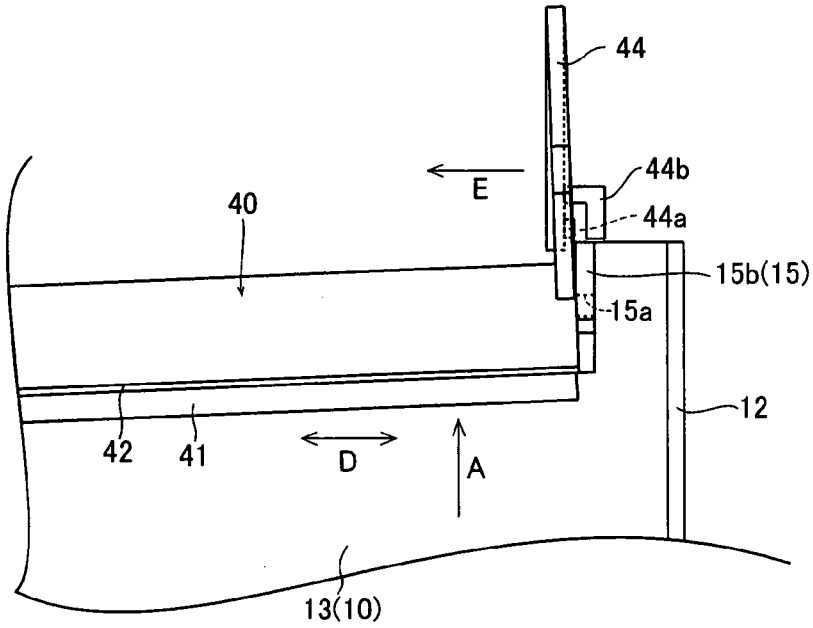
FIG. 13 is an enlarged plan view for illustrating the method of mounting the print head on the chassis in the thermal transfer printer according to the embodiment of the present invention.

At this time, force acts on the first arm 43 for moving the same along arrow E shown in FIG. 13. However, the first stop portion 43*b* of the first arm 43 is engaged with the first arm mounting portion 14 as shown in FIG. 11, thereby inhibiting the first arm 43 from slipping off the first arm mounting portion 14.

Figure 14:
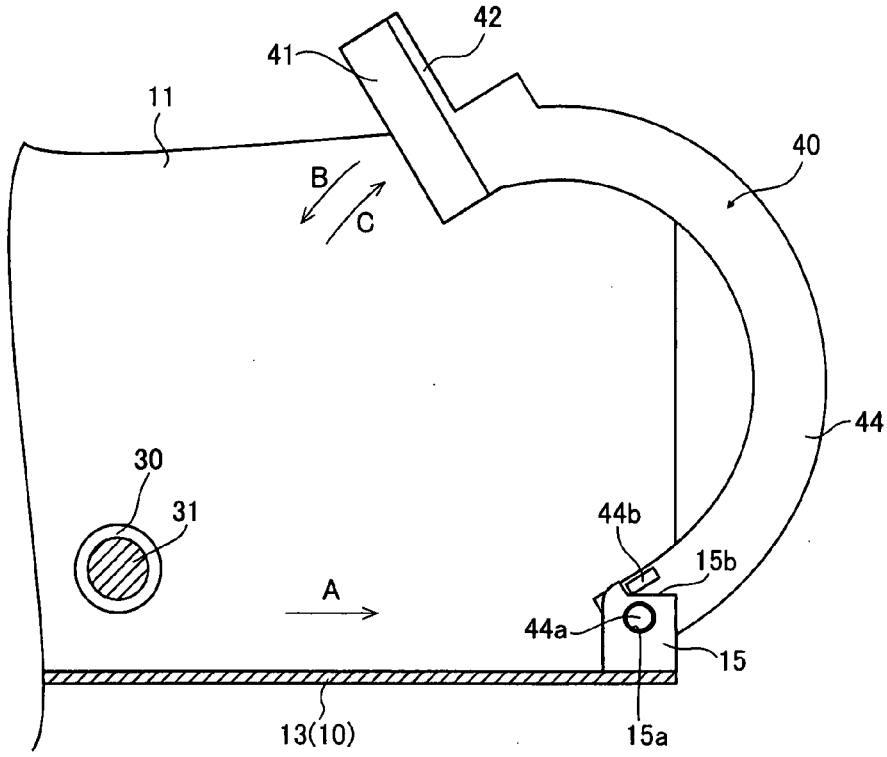
FIG. 14 is a sectional view taken along the line 200-200 in FIG. 4 for illustrating the method of mounting the print head on the chassis in the thermal transfer printer according to the embodiment of the present invention.
Figure 15:
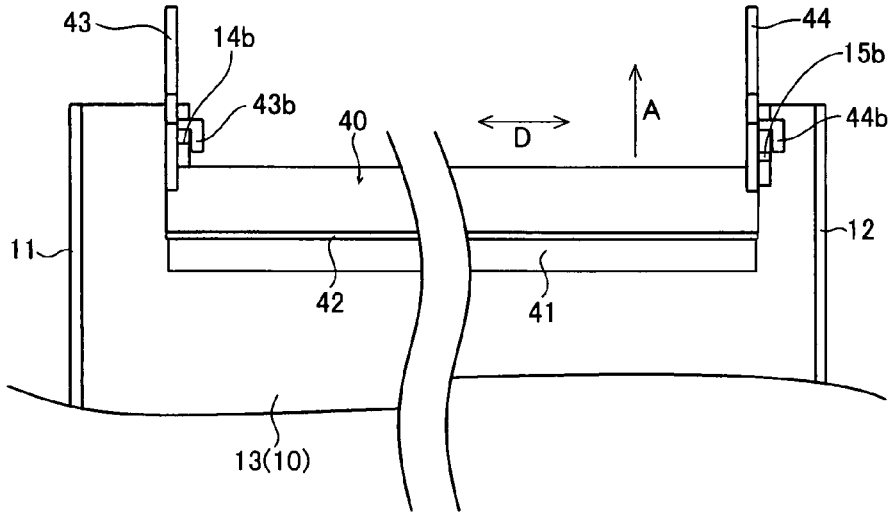
FIG. 15 is a plan view for illustrating the method of mounting the print head on the chassis in the thermal transfer printer according to the embodiment of the present invention.

The second notch 15*b* has the notch angle β (see FIGS. 3 and 8) larger than the notch angle α (see FIGS. 3 and 7) of the first notch 14*b*, whereby the second stop portion 44*b* of the second arm 44 is relieved through the second notch 15*b* of the second arm mounting portion 15 when the second rotation axis 44*a* is arranged in the vicinity of the second hole 15*a*, as shown in FIGS. 14 and 15. Thus, the second rotation axis 44*a* of the second arm 44 can be inserted into the second hole 15*a* of the second arm mounting portion 15.

Thereafter the print head 40 is further rotated along arrow B in FIG. 14, thereby engaging the second stop portion 44*b* with the second arm mounting portion 15 in the direction of the rotation axis 44*a* (along arrow B). Thus, the first and second arms 43 and 44 are mounted on the first and second arm mounting portions 14 and 15 respectively, as shown in FIGS. 2, 7 and 8.

In the thermal transfer printer according to this embodiment, the print head 40 is mounted on the chassis 10 in the aforementioned manner.

According to this embodiment, as hereinabove described, the first and second arms 43 and 44 of the print head 40 mounted on the chassis 10 are provided with the first and second stop portions 43*b* and 44*b* regulating movement of the print head 40 in the direction of the rotation axes 43*a* and 44*a* (along arrow D) respectively, whereby the print head 40 can be inhibited from deviating in the direction of the rotation axes 43*a* and 44*a* (along arrow D). Thus, the first and second arms 43 and 44 of the print head 40 can be inhibited from slipping of the first and second arm mounting portions 14 and 15 of the chassis 10 respectively, thereby inhibiting the print head 40 from dropping. Further, the first and second stop portions 43*b* and 44*b* are integrally provided on the first and second arms 43 and 44 respectively, whereby the print head 40 can be inhibited from deviating in the direction of the rotation axes 43*a* and 44*a* (along arrow D) while suppressing increase of the number of components.

According to this embodiment, as hereinabove described, the angular range in which the first arm 43 of the print head 40 is mountable on/dismountable from the first arm mounting portion 14 of the chassis 10 is rendered different from the angular range in which the second arm 44 of the print head 40 is mountable on/dismountable from the second arm mounting portion 15 of the chassis 10 while the print head 40 is rotated after the first and second arms 43 and 44 of the print head 40 are mounted on the first and second arm mounting portions 14 and 15 of the chassis 10 in the different angular ranges respectively to be stopped in the direction of the rotation axes 43*a* and 44*a* (along arrow D) through the first and second stop portions 43*b* and 44*b*, whereby the first and second arms 43 and 44 can be easily and reliably mounted on the first and second mounting portions 14 and 15 of the chassis 10 respectively independently of each other when it is difficult to simultaneously mount the first and second arms 43 and 44 on the first and second mounting portions 14 and 15 respectively.

Further, the first arm 43 is mounted on the first arm mounting portion 14 and the print head 40 is rotated in the prescribed angular range so that the first arm 43 is stopped from slipping off the first arm mounting portion 14 through the first stop portion 43*b* and the second arm 44 is mounted on the second arm mounting portion 15, whereby the first arm 43 can be inhibited from slipping off the first mounting portion 14 when the second arm 44 is mounted on the second mounting portion 15 and workability in mounting can be improved.

According to this embodiment, as hereinabove described, the distance D3 between the side surfaces of the first and second arm mounting portions 14 and 15 of the chassis 10 mounted with the first and second arms 43 and 44 respectively is substantially equal to the distance D4 between the side surfaces of the first and second arms 43 and 44 of the print head 40 mounted on the first and second arm mounting portions 14 and 15 respectively, whereby the first and second arms 43 and 44 mounted on the first and second arm mounting portions 14 and 15 respectively can be inhibited from deflecting and pressing the side surfaces of the first and second arm mounting portions 14 and 15 mounted with the first and second arms 43 and 44 respectively. Thus, pressing force can be inhibited from acting between the first and second arm mounting portions 14 and 15 of the chassis 10 and the first and second arms 43 and 44 in rotation of the print head 40, whereby the print head 40 can be smoothly rotated.

According to this embodiment, as hereinabove described, the first and second notches 14*b* and 15*b* having different shapes are provided on the first and second arm mounting portions 14 and 15 of the chassis 10 respectively for relieving the first and second stop portions 43*b* and 44*b* through the first and second notches 14*b* and 15*b* when the first and second arms 43 and 44 of the print head 40 are mounted on the first and second arm mounting portions 14 and 15 respectively, whereby the angular range in which the first arm 43 of the print head 40 is mountable on/dismountable from the first arm mounting portion 14 of the chassis 10 can be easily rendered different from the angular range in which the second arm 44 of the print head 40 is mountable on/dismountable from the second arm mounting portion 15 of the chassis 10 due to the different shapes of the first and second notches 14*b* and 15*b*.

According to this embodiment, as hereinabove described, the first and second notches 14*b* and 15*b* of the first and second arm mounting portions 14 and 15 of the chassis 10 have different notch angles, whereby the angular range in which the first arm 43 of the print head 40 is mountable on/dismountable from the first arm mounting portion 14 of the chassis 10 can be easily rendered different from the angular range in which the second arm 44 of the print head 40 is mountable on/dismountable from the second arm mounting portion 15 of the chassis 10 through the first and second notches 14*b* and 15*b*.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the thermal transfer printer employed as an exemplary image generating apparatus, the present invention is not restricted to this but is also applicable to an image generating apparatus other than the thermal transfer printer so far as the same comprises a print head.

While the notch angles $\alpha$ and $\beta$ of the first and second notches 14*b* and 15*b* of the first and second arm mounting portions 14 and 15 are rendered different from each other so that the angular range in which the first arm 43 is mountable on/dismountable from the first arm mounting portion 14 is different from the angular range in which the second arm 44 is mountable on/dismountable from the second arm mounting portion 15 in the aforementioned embodiment, the present invention is not restricted to this but the shapes, lengths or sizes of the first and second stop portions 43*b* and 44*b* may alternatively be rendered different from each other so that the angular range in which the first arm 43 is mountable on/dismountable from the first arm mounting portion 14 is different from the angular range in which the second arm 44 is mountable on/dismountable from the second arm mounting portion 15.

While the first and second arm mounting portions 14 and 15 are provided on the bottom surface 13 of the chassis 10 in the aforementioned embodiment, the present invention is not restricted to this but the first and second arm mounting portions 14 and 15 may alternatively be provided on the first and second side surfaces 11 and 12 of the chassis 10 respectively.

What is claimed is:

1. An image generating apparatus comprising:

a chassis including a first mounting portion and a second mounting portion; and a print head including a plate-like first arm and a plate-like second arm rotatably mounted on said first mounting portion and said second mounting portion of said chassis respectively, wherein said first arm and said second arm of said print head are integrally provided with an L-shaped first stop portion and an L-shaped second stop portion regulating movement of said print head in the direction of a rotation axis respectively, a first angular range in which said first arm of said print head is mountable on/dismountable from said first mounting portion of said chassis limited by said first stop portion is different from a second angular range in which said second arm of said print head is mountable on/dismountable from said second mounting portion of said chassis limited by said second stop portion, said first arm and said second arm of said print head are mounted on said first mounting portion and said second mounting portion of said chassis in said first angular range and said second angular range respectively and said print head is thereafter so rotated that said print head is stopped by said first stop portion and said second stop portion in the direction of said rotation axis, said first arm is mounted on said first mounting portion such that said first mounting portion is sandwiched between said first arm and said first stop portion, said second arm is mounted on said second mounting portion such that said second mounting portion is sandwiched between said second arm and said second stop portion, said first mounting portion of said chassis is provided with a first notch relieving said first stop portion when said first arm is mounted on said first mounting portion, said second mounting portion of said chassis is provided with a second notch relieving said second stop portion when said second arm is mounted on said second mounting portion, and said first notch and said second notch are so formed as to have different notch angles, so that said first angular range and said second angular range are different from each other.

2. The image generating apparatus according to claim 1, wherein the distance between a side surface of said first mounting portion of said chassis mounted with said first arm and a side surface of said second mounting portion of said chassis mounted with said second arm is substantially equal to the distance between a side surface of said first arm mounted on said first mounting portion and a side surface of said second arm mounted on said second mounting portion.

3. The image generating apparatus according to claim 1, wherein said first mounting portion and said second mounting portion are integrally formed on said chassis by partially uprighting the bottom surface of said chassis.

4. The image generating apparatus according to claim 1, wherein said first arm and said second arm include a first protrusion and a second protrusion each serving as said rotation axis respectively, and said first mounting portion and said second mounting portion include a first receiving hole and a second receiving hole receiving said first protrusion and said second protrusion respectively.

5. The image generating apparatus according to claim 4, wherein the projection lengths of said first protrusion and said second protrusion are not more than the thicknesses of said first mounting portion and said second mounting portion respectively.

6. The image generating apparatus according to claim 1, wherein said first stop portion and said second stop portion include a first L-shaped stop section and a second L-shaped stop section protruding from said first arm and said second arm respectively.

7. The image generating apparatus according to claim 6, wherein the lengths of portions of said first stop section and said second stop section holding said first mounting portion and said second mounting portion are substantially equal to the thicknesses of said first mounting portion and said second mounting portion respectively.

8. An image generating apparatus comprising:

a chassis; and a print head, wherein said chassis includes a first mounting portion and a second mounting portion, said print head includes a plate-like first arm and a plate-like second arm rotatably mounted on said first mounting portion and said second mounting portion of said chassis respectively, said first arm and said second arm of said print head are integrally provided with an L-shaped first stop portion and an L-shaped second stop portion regulating movement of said print head in the direction of a rotation axis respectively, a first angular range in which said first arm of said print head is mountable on/dismountable from said first mounting portion of said chassis limited by said first stop portion is different from a second angular range in which said second arm of said print head is mountable on/dismountable from said second mounting portion of said chassis limited by said second stop portion, said first arm and said second arm of said print head are mounted on said first mounting portion and said second mounting portion of said chassis in said first angular range and said second angular range respectively and said print head is thereafter so rotated that said print head is stopped by said first stop portion and said second stop portion in the direction of said rotation axis, said first arm is mounted on said first mounting portion in said first angular range and said print head is thereafter rotated in a prescribed angular range to reach said second angular range for bringing said first arm into a first state stopped from slipping off said first mounting portion by said first stop portion and mounting said second arm on said second mounting portion in said first state, the distance between a side surface of said first mounting portion of said chassis mounted with said first arm and a side surface of said second mounting portion of said chassis mounted with said second arm is substantially equal to the distance between a side surface of said first arm mounted on said first mounting portion and a side surface of said second arm mounted on said second mounting portion, said first arm is mounted on said first mounting portion such that said first mounting portion is sandwiched between said first arm and said first stop portion, said second arm is mounted on said second mounting portion such that said second mounting portion is sandwiched between said second arm and said second stop portion, said first mounting portion of said chassis is provided with a first notch relieving said first stop portion when said first arm is mounted on said first mounting portion, said second mounting portion of said chassis is provided with a second notch relieving said second stop portion when said second arm is mounted on said second mounting portion, and said first notch and said second notch are so formed as to have different notch angles, so that said first angular range and said second angular range are different from each other.

9. The image generating apparatus according to claim 8, wherein said first mounting portion and said second mounting portion are integrally formed on said chassis by partially uprighting the bottom surface of said chassis.

10. The image generating apparatus according to claim 8, wherein said first arm and said second arm include a first protrusion and a second protrusion each serving as said rotation axis respectively, and said first mounting portion and said second mounting portion include a first receiving hole and a second receiving hole receiving said first protrusion and said second protrusion respectively.

11. The image generating apparatus according to claim 10, wherein the projection lengths of said first protrusion and said second protrusion are not more than the thicknesses of said first mounting portion and said second mounting portion respectively.

12. The image generating apparatus according to claim 8, wherein said first stop portion and said second stop portion include a first L-shaped stop section and a second L-shaped stop section protruding from said first arm and said second arm respectively.

13. The image generating apparatus according to claim 12, wherein the lengths of portions of said first stop section and said second stop section holding said first mounting portion and said second mounting portion are substantially equal to the thicknesses of said first mounting portion and said second mounting portion respectively.

* * * * *